US006394598B1

(12) United States Patent
Kaiser

(10) Patent No.: US 6,394,598 B1
(45) Date of Patent: May 28, 2002

(54) INK JET MARKER

(75) Inventor: Richard J. Kaiser, Allentown, PA (US)

(73) Assignee: Binney & Smith Inc., Easton, PA (US)

( * ) Notice: Subject to any disclaimer, the term of this patent is extended or adjusted under 35 U.S.C. 154(b) by 0 days.

(21) Appl. No.: 09/572,663

(22) Filed: May 16, 2000

Related U.S. Application Data

(63) Continuation-in-part of application No. 08/848,065, filed on Apr. 28, 1997.

(51) Int. Cl.[7] ..... B41J 3/36
(52) U.S. Cl. ..... 347/109
(58) Field of Search ..... 347/109, 43; 400/88

(56) References Cited

U.S. PATENT DOCUMENTS

| | | | | |
|---|---|---|---|---|
| 3,683,212 A | | 8/1972 | Zoltan | 310/8.3 |
| 3,747,120 A | | 7/1973 | Stemme | 346/75 |
| 3,832,579 A | | 8/1974 | Arndt | 310/8.1 |
| 3,940,773 A | | 2/1976 | Mizoguchi et al. | 346/140 |
| 4,072,958 A | | 2/1978 | Hayami et al. | 346/140 |
| 4,161,670 A | | 7/1979 | Kern | 310/317 |
| 4,412,232 A | | 10/1983 | Weber et al. | 347/68 |
| 4,412,233 A | | 10/1983 | Thomas et al. | 347/85 |
| 4,459,601 A | | 7/1984 | Howkins | 346/140 |
| 4,549,243 A | | 10/1985 | Owen et al. | 347/109 |
| 4,743,924 A | | 5/1988 | Scardovi | 347/10 |
| 4,748,460 A | | 5/1988 | Piatt et al. | 347/109 |
| 5,220,342 A | | 6/1993 | Moriyama | 347/41 |
| 5,274,400 A | | 12/1993 | Johnson et al. | 346/140 |
| 5,387,976 A | | 2/1995 | Lesniak | 347/100 |
| 5,501,535 A | * | 3/1996 | Hastings et al. | 347/109 |
| 5,593,236 A | | 1/1997 | Bobry | 400/88 |
| 5,634,730 A | | 6/1997 | Bobry | 400/88 |
| 5,654,744 A | | 8/1997 | Nicoloff, Jr. et al. | 347/43 |
| 5,825,995 A | * | 10/1998 | Wiklof et al. | 358/401 |
| 5,861,877 A | * | 1/1999 | Kagayama et al. | 345/179 |

FOREIGN PATENT DOCUMENTS

| | | |
|---|---|---|
| DE | 25 37 767 C2 | 9/1977 |
| GB | 1350836 | 4/1974 |

OTHER PUBLICATIONS

"Ink–Jet Printing," by J. Heinzel et al., *Advances In Electronics And Electron Physics*, vol. 65, pp. 91–171.

"Recent Advances In Ink Jet Technology," by J.G. Martner, pp. 364–372.

"A Review of Ink–Jet Printing," by Doane, *Journal of Applied Photographic Engineering*, vol. 7, No. 5, Oct. 1981, pp. 121–125.

* cited by examiner

*Primary Examiner*—Thinh Nguyen
(74) *Attorney, Agent, or Firm*—Leydig, Voit & Mayer, Ltd.; John M. Augustyn

(57) ABSTRACT

An ink jet marker includes a writing instrument body with a cartridge disposed therein. A printing nozzle is coupled with said reservoir and receives control signals from an electrical control circuit to dispense ink droplets according to user input.

12 Claims, 18 Drawing Sheets

INK JET MARKER

CROSS REFERENCE TO RELATED APPLICATIONS

This application is a continuation-in-part of application Ser. No. 08/848,065, filed on Apr. 28, 1997, the subject matter of which is incorporated herein by reference in its entirety.

FIELD OF THE INVENTION

The present invention relates generally to the ink jet printing art, and in particular, to a hand-held marking device which utilizes an ink jet print-head in order to selectively apply ink to a print medium. Preferably, the print-head is part of a replaceable cartridge that may be replaced as desired.

BACKGROUND OF THE INVENTION

Various ink jet technologies that are utilized in conjunction with printer devices are known in the art. These generally include continuous feed ink jet systems and drop-on-demand systems. One such printer that is based on a drop-on-demand system utilizes a print-head that is disposed on a carriage. The carriage is translatable over a print medium. Relatively sophisticated electronics are employed including timing and encoding circuitry to move the print medium in a first direction and to move the carriage in an orthogonal direction thereto.

The print-head in these systems typically comprises a piezoelectric transducer, an ink chamber, and an ejection nozzle. The transducer is disposed to selectively vibrate the ink chamber in proximate relation to the ejection nozzle. In operation, a non-pressurized ink pulse jet is generated at a desired frequency, i.e., 1 to 10 kHz. The ink drops are generated on demand by a transient pressure pulse and directed toward a receiving surface. Volume changes in the ink chamber located behind the ink ejection nozzle cause the droplets to eject. These volume changes are generated by the piezoelectric transducer.

The impulse jets are relatively compact in design. Accordingly, print-heads based on this technology typically have arrays which include tens of nozzles operating synchronously.

Another technology which is known is the "bubble jet" or thermal jet printing technology. In these types of printers, a supply channel is provided which leads from an ink reservoir to one or a plurality of nozzles on an orifice plate. This supply channel is designed to provide a certain amount of resistance to flow. A thermo-electric transducer disposed proximate to the supply channel heats up the ink and produces a small vapor bubble. The vapor bubble drives the ink from the nozzle with a certain force. The maximum ejection frequency is approximately 4 kHz.

While these systems perform satisfactorily in printing capacities for which they are intended, it would be desirable to have a hand-held marking device based on these technologies.

SUMMARY OF THE INVENTION

Accordingly, it is an object of the invention to provide a hand-held marker that utilizes an ink jet technology.

It is a further object of the invention to provide an ink jet marker that is relatively simple in design and construction.

It is a further object of the invention to provide an ink jet marker that includes a replaceable cartridge that may be readily installed or removed from a marker body.

The present invention provides these and other additional objects and advantages in an ink jet marking device. The marking device comprises an elongated body having a generally cylindrical or other desired shape and adapted for use as a writing instrument. A replaceable cartridge containing a reservoir of ink is disposed within the body, preferably at one end of the device body. The marking device also comprises an ink jet print-head disposed at the opposite end of the instrument body, and in fluid communication with the reservoir. The print-head includes a plurality of ejection nozzles adapted to dispense a selected amount of ink upon receipt of control signals by the print-head. The marking device also comprises an electrical control circuit coupled to the ink jet print-head disposed to provide the control signals to the ink jet print-head.

In one embodiment, the electrical control circuit is located in a base station console. The electrical circuit is connected to the print-head with electrical terminals. Alternatively, the electrical control circuit is disposed within the cylindrical body of the marking device.

In another aspect of the invention, a replaceable ink cartridge is provided for insertion within a hand-held writing instrument body. The cartridge includes a reservoir of ink adapted for placement within the body and optionally a print-head. The print-head includes a plurality of ejection nozzles coupled with the reservoir. The print-head is adapted to dispense selected amounts of ink from the plurality of ejection nozzles upon receipt of control signals provided by an electrical circuit. In one embodiment, a thin film battery is wrapped around the reservoir body.

DETAILED DESCRIPTION OF THE INVENTION

Generally, the present invention relates to a hand-held ink jet marker. The invention is relatively simple in design and construction, while being readily usable for a wide variety of marking or writing tasks. According to one feature of the invention, the marker includes a replaceable ink jet cartridge that may be readily installed into the marker.

Figure 1:
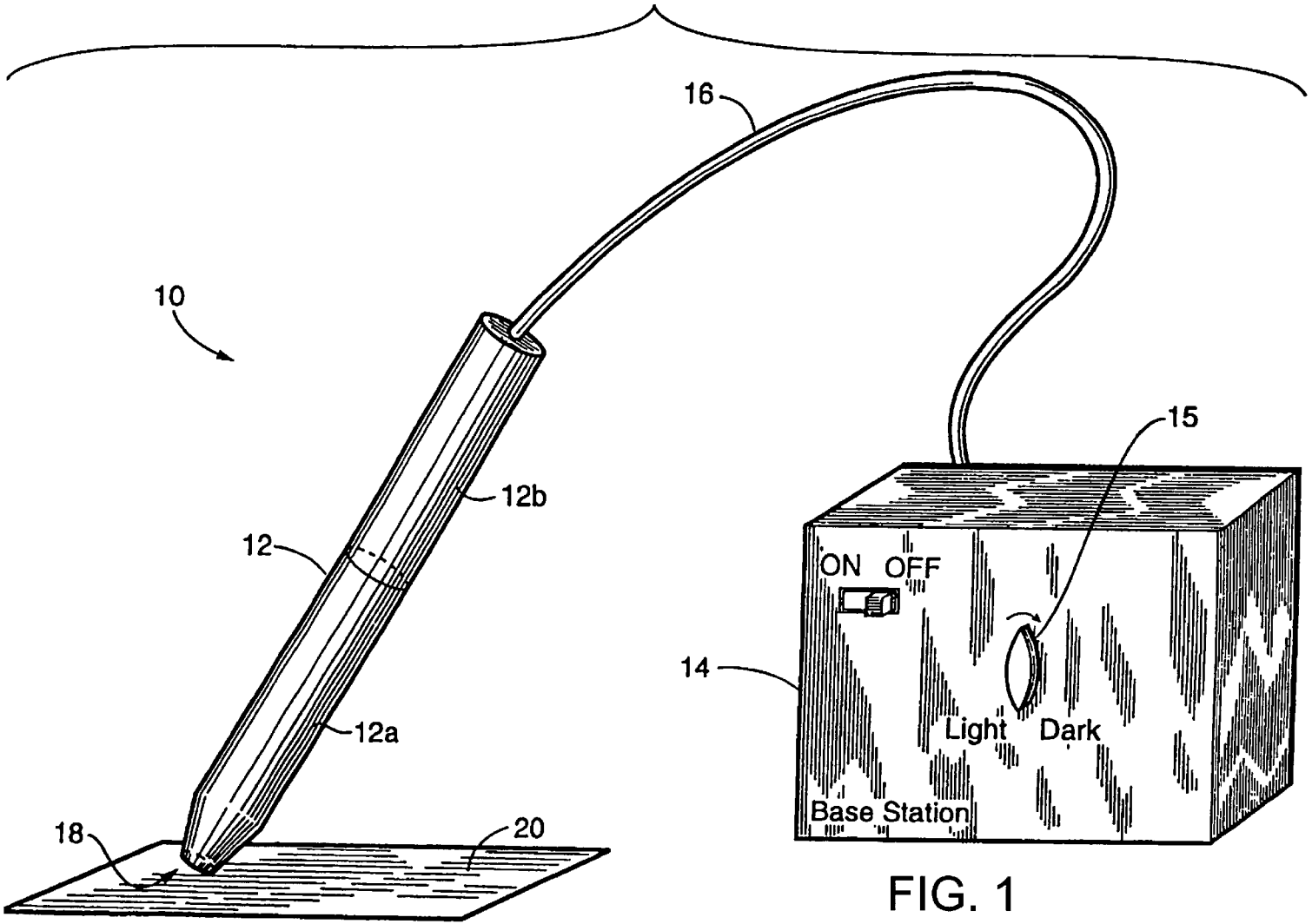
FIG. 1 is a perspective view of a writing instrument according to the present invention.

FIG. 1 illustrates an ink jet marker 10 according to one embodiment of the invention. The marker 10 comprises a longitudinally extending, generally cylindrical body or handle 12, a base station 14, and electrical connection terminals 16 disposed at one end of the body 12 that electrically connects the body 12 with the base station 14. While the embodiment shown in FIG. 1 is a cylindrical body, it may also be designed in other desired shapes, such as an oval shape or as an ergonomically designed body for ready hand manipulation. The opposite end of the body 12 contains a marking or print-head 18 disposed to receive a supply of ink from an ink reservoir (see FIG. 2). The body may be provided with cooperating first and second pieces 12*a* and 12*b* that are connected with threads as will be understood by those skilled in the art.

The print-head 18 is electrically coupled with the control station 14 and, in response to control signals received therefrom, selectively ejects a stream or predetermined pattern of ink droplets onto a writing or print medium 20. The embodiment shown is a single nozzle ink jet writing device. This arrangement provides a unique and unobvious arrangement that is suitable for many applications.

Figure 2:
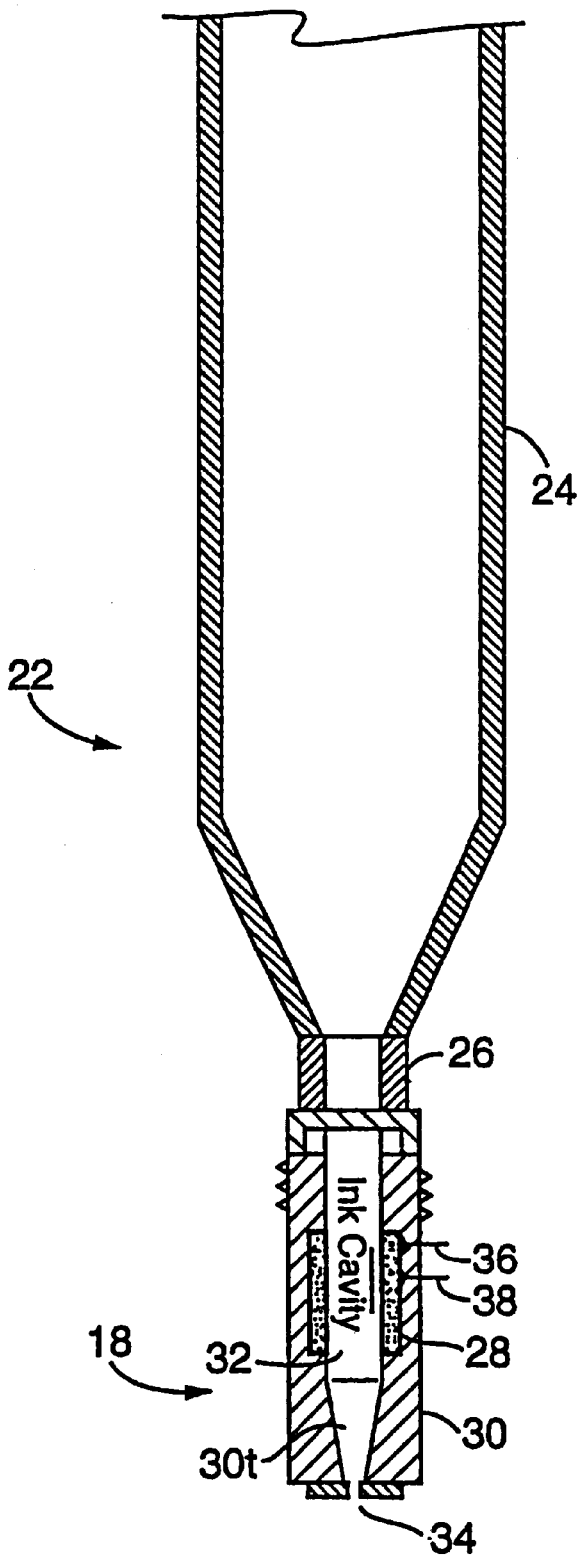
FIG. 2 illustrates an enlarged cross section view of a cartridge including an ink reservoir and a print-head of one embodiment of the writing instrument shown in FIG. 1.

FIG. 2 shows in cross section the details of an ink jet cartridge 22 which may be utilized in the writing instrument 10 of FIG. 1. The cartridge 22 comprises the print-head 18, an elongated ink reservoir 24 and a flexible connecting hose 26 disposed between the print-head 18 and the reservoir 24.

One important advantage of one embodiment of the invention is that the ink jet cartridge 22 is provided as a replaceable unit. In this regard, the cartridge 22 is insertable into the body 12 and secured thereto via suitable connection means such as threads.

The details of the print-head 18 fabricated in accordance with one embodiment of the invention are also shown in FIG. 2. The print-head 18 comprises a cylindrical piezoelectric driver element 28 disposed in an annular print-head housing 30. The housing 30 forms an ejection nozzle including an ink cavity 32 in proximate relation to the driver element 28. The ink cavity 24 is coupled with the ink reservoir 24 via the flexible hose 26 disposed at one end of the housing 30. The housing 30 includes a tapered section 30*t* at its opposite end. As described below, the tapered section 30*t* is configured to smooth out the ink flow which will form a droplet. An orifice or ejection nozzle 34 is located at the distal end of the housing 30.

The piezoelectric driver element 28 is a transducer that receives electric signals from a pair of conductors 36, 38. In response, the driver element 28 selectively applies pressure pulses to the ink drawn into the ink cavity 32 as desired. Such application of pressure pulses accelerates the ink toward the nozzle end of the cavity. An ink droplet of a diameter comparable to that of the orifice 34 will be formed when the impulse of the ink pressure wave exceeds the surface tension of the meniscus at the orifice. In one embodiment, ink droplets may be ejected with a velocity of between 2–20 m/s.

Inasmuch as the volume change of the piezoelectric transducer 28 increases linearly with the applied voltage, the volume or mass of a generated ink droplet is also proportional to the applied voltage. In one embodiment, the impulse amplitude is sufficiently large, on the order of 60 volts.

Figure 3A:
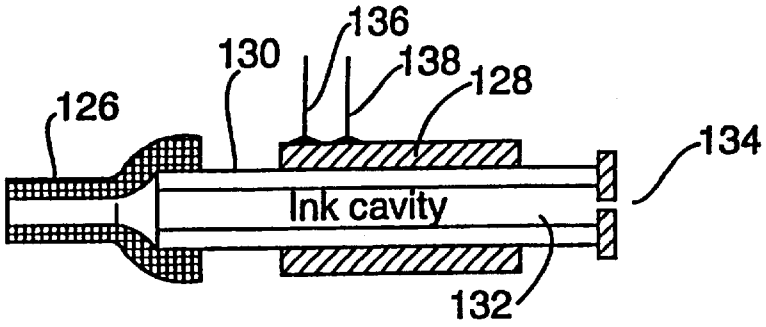
FIGS. 3A and 3B are cross-sectional or cut-away views which illustrate other forms of a print-head which may be used in conjunction with the invention.
Figure 3B:
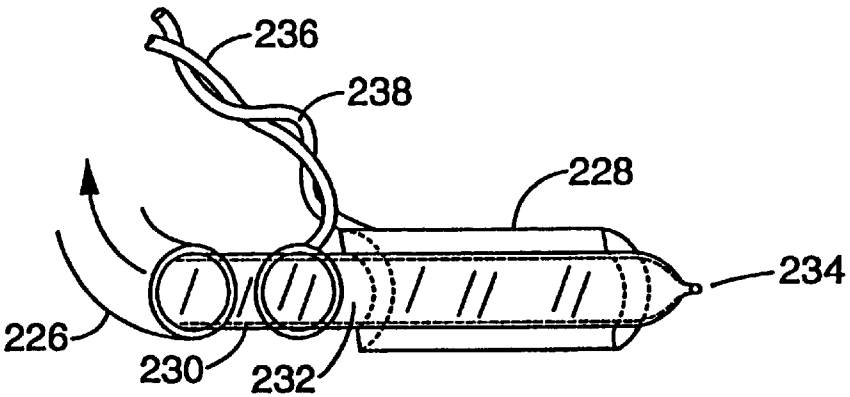

FIG. 3A and FIG. 3B illustrate slight variations of the print-head configuration shown in FIG. 2. FIG. 3A is a cross section showing an ink cavity 132 defined by a generally cylindrical capillary tube 130. A fluid connection hose 126 is coupled with one end of the housing 130 and to an ink supply. An orifice 134 is disposed at the distal end of the housing. A transducer element 128 is disposed in surrounding relation with respect to the ink cavity 132 and is connected to terminals 136, 138.

Similarly, FIG. 3B shows a cylindrical ink cavity 232 defined by a capillary tubular housing 230. A flexible hose 226 is likewise coupled with one end of the tubular housing 230 and to an ink supply. As with the embodiment shown in FIG. 2, the housing 230 is likewise tapered at its distal end to smooth out the ink flow forming a droplet and terminates to define an orifice 234. A transducer element 228 is disposed in surrounding relation with respect to the ink cavity 232 and is connected to terminals 236, 238.

Figure 4:
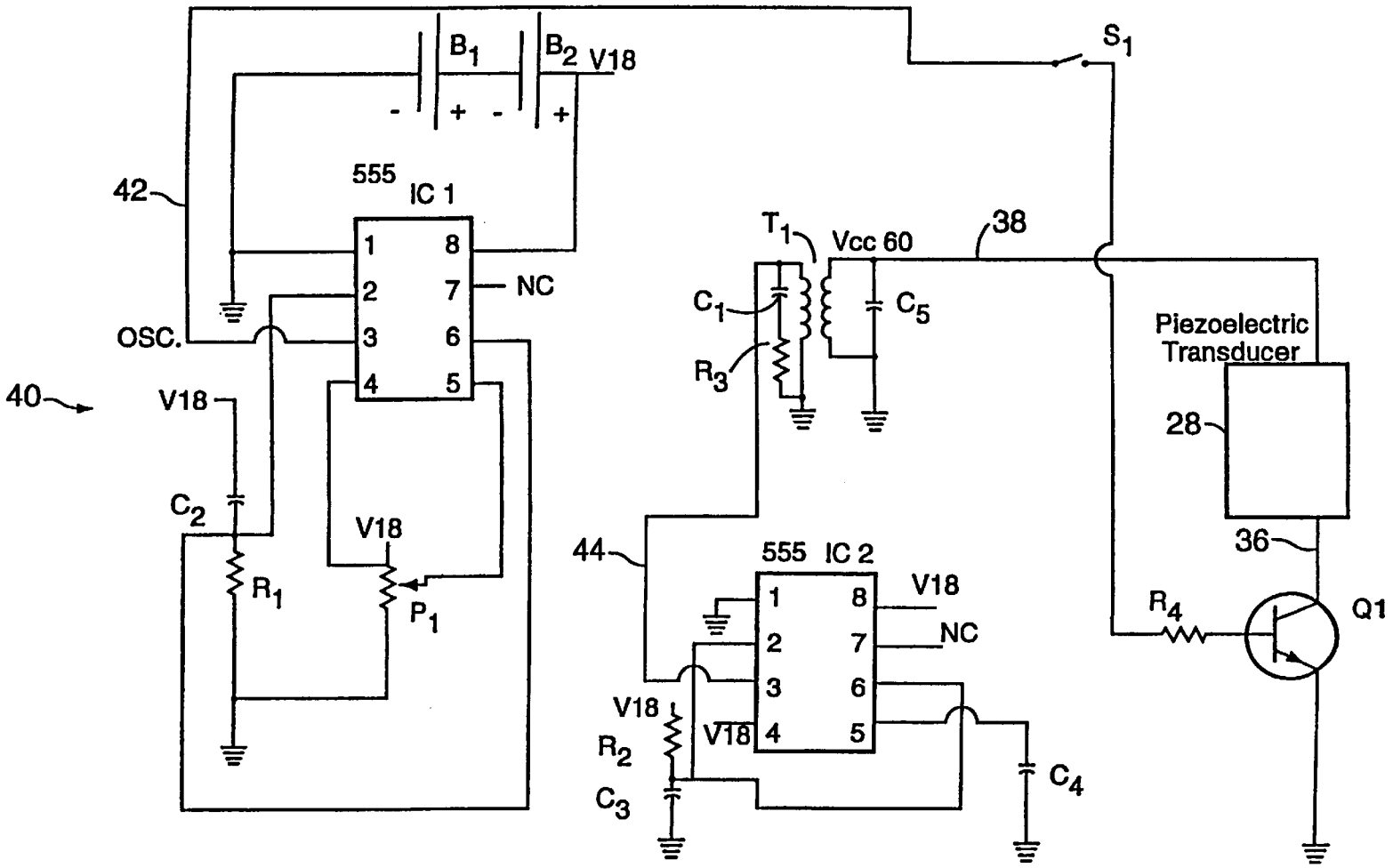
FIG. 4 is a simplified electrical schematic diagram suitable for providing control signals to the print-head shown in FIGS 2, 3A or 3B.

FIG. 4 is a simplified circuit diagram of a circuit 40 suitable for driving the piezoelectric print-head 18 shown in FIG. 2. The circuit 40 includes a pair of integrated circuit timers IC1 and IC2. In one embodiment, timers IC1 and IC2 are type IC 555 linear timer circuits having a pin configuration that is well known. Timer IC1 has its terminals connected to operate in an astable mode as an oscillator. Accordingly, IC1 provides a clock signal at its output denoted by a line 42. In this regard, a potentiometer P1 is connected to the trigger level threshold input terminal of timer IC1 to vary the frequency of oscillation of timer IC1. Optionally, the potentiometer P1 may be adjusted by the control knob 15 shown in FIG. 1 to adjust the intensity of the resulting ink dispersion.

The output signal on the line 42 is supplied through a switch S1 and a resistor R4 to the base terminal of a transistor Q1. The collector terminal of transistor Q1 is connected to one of the terminals of the piezoelectric transducer 28 on the line 36. The emitter terminal of the transistor Q1 is connected to ground. Accordingly, when the switch S1 is closed, an oscillating signal is provided to the transducer element 28.

The ink jet droplets are preferably formed upon the application of voltage output levels of between 50 to 200 volts. In this regard, a pair of alkaline batteries B1 and B2 are used to provide a constant voltage of about 18 V DC. Of course, other voltage sources such as a 5 volt or 12 volt source may be utilized with appropriate modification. This DC voltage is applied to the second timer IC2. The second timer IC2 is used as a pulse width modulator for adjusting the voltage signal provided to the transducer element 28 and thereby control the ink-jet dispersion. In this regard, the second timer IC2 transforms the received voltage into a pulsed output signal on a line 44 having a frequency of about 400 Hz in one embodiment. The signal on the line 44 is applied to the primary winding of a step-up transformer T1. In one embodiment, the transformer T1 has a turns ratio of 1-to-3. The output of the secondary winding of transformer T1 is thus about 54 volts. This output is supplied via the line 38 to the transducer element 28. Inasmuch as the signal shape and timing are important aspects for proper functioning of the piezoelectric transducer element, low capacitance cabling is preferably utilized to link the marker with the base station.

FIG. 4 also shows a snubber capacitor C1 having one of its terminals connected to the primary winding of the transformer T1. The second terminal of the snubber capacitor C1 is connected through a resistor R3 to ground. This arrangement protects the output of the second timer IC2. A filter capacitor C5 is connected between the terminals of the secondary winding of transformer T1 and is used to provide a filtered 54 V DC signal. The second IC timer IC2 can supply sufficient current (i.e., 200 mA) in order to drive multiple ejection nozzles, as is explained in greater detail below.

Figure 5:
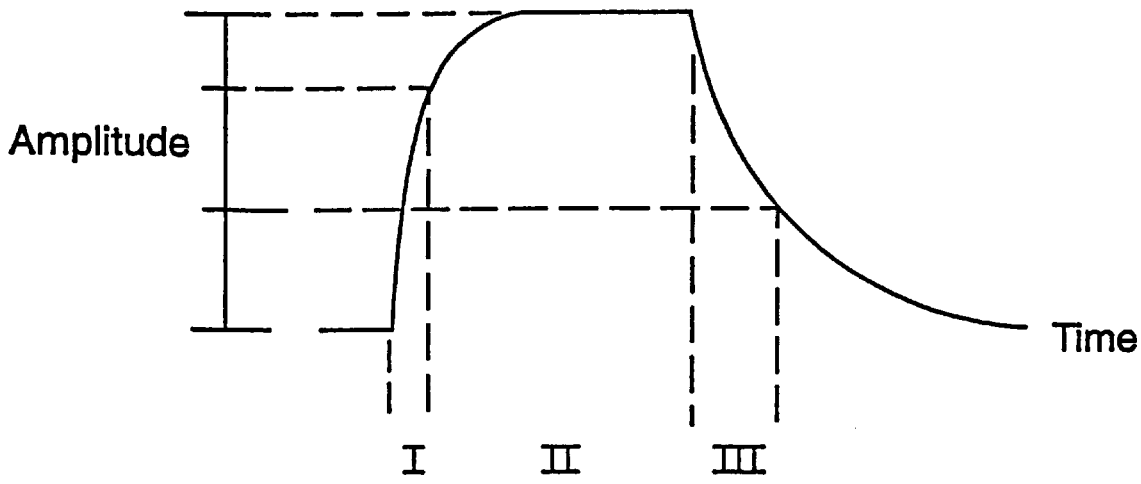
FIG. 5 is an output waveform of a signal provided by the circuit shown in FIG. 4.

The drop formation mechanism can be described with respect to three segments of an electrical voltage pulse applied by the control circuit 40 to the transducer element 28, as shown in FIG. 5. In Segment I, the ink in the meniscus disposed within the ink cavity or chamber 32 is initially substantially at rest. An electric pulse such as that shown in FIG. 5 is then applied to excite the peizo-electric transducer 28. A relatively short rise time in the applied voltage induces a contraction of the tubular housing 30 which results in a pressure increase within the ink chamber 32.

As a result of the excitation and the resulting pressure increase, the ink flows in opposite directions: toward the ejection orifice 34 which bulges out the ink at the meniscus; and, toward the ink supply line 26. In this regard, the flexible ink hose 26, connecting the ink cavity 32 with the reservoir 24, tends to absorb the pressure wave propagation towards the reservoir. This tends to minimize pressure wave reflection of the ink, which could otherwise interfere with the droplet ejection at the orifice 34.

In Segment II, the input voltage pulse has achieved its peak value, i.e., approximately 60 volts. The ink continues to accelerate and reaches a maximum velocity, nearly twice the velocity of the resulting droplet. The separation of an ink droplet from the ink in the meniscus occurs in the relatively short dwell mode during Segment II.

In a next Segment III, the input voltage is decreased. The resulting surface tension forces reduce the ink flow and eventually reverse the ink flow. In particular, the input voltage decrease causes a compression of the ink chamber 32 and a negative pressure at the orifice 34. The ink reverses flow from both the orifice 34 and ink supply 26 toward the center of the ink chamber 32 and the meniscus becomes concave.

Eventually, the lost ink due to the ejected droplet is refilled by capillary action in the ink chamber 32. In the case of an orifice diameter of about 50 to 80 microns with an effective length of the meniscus at the orifice during refill of about 0.9–1.3 mm and a surface tension of the ink of about 40–50 dynes/cm, the resulting upper frequency of dispersion of ink droplets is about 10 kHz.

Figure 6:
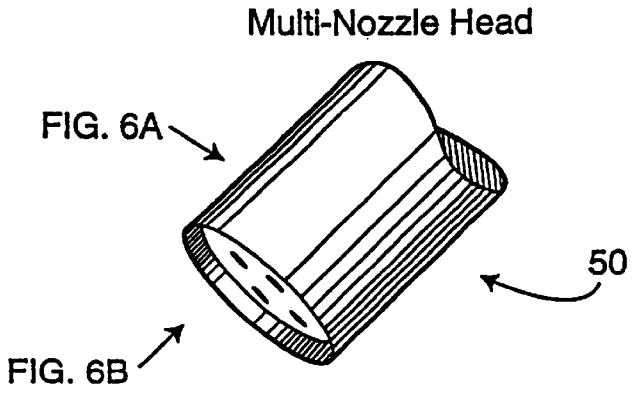
FIG. 6 is a perspective view illustrating a print-head with multiple ejection nozzles according to another embodiment of the invention.
Figure 6A:
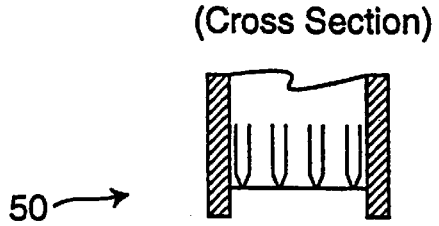
FIG. 6A is a cross-sectional view of the print-head with multiple ejection nozzles taken along the lines 6A—6A shown in FIG. 6.
Figure 6B:
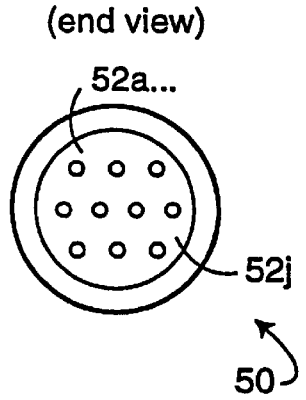
FIG. 6B is a bottom view of the print-head with multiple ejection nozzles shown in FIG. 6.

FIG. 6, FIG. 6A and FIG. 6B illustrate a different print-head 50 according to another embodiment of the present invention. In this embodiment, a multiplicity of ejection nozzles or orifices are employed such as orifices 52*a*–52*j* shown in FIG. 6B. The plurality of orifices are relatively closely spaced from each other, i.e., within a few microns apart, and are arranged in a preselected bank or pattern as shown in FIG. 6B. In this embodiment, each of the plurality of orifices has an associated transducer element such as element 28 shown in FIG. 2 associated therewith. This arrangement permits a pattern to be generated on a print medium upon selective actuation of the transducer elements.

The circuit 40 shown in FIG. 4 may be employed to provide control signals to each of the ejection nozzles 52*a* through 52*j*. The resulting dispersion of ink to the print medium will be of a greater intensity than the pattern generated by one ejection nozzle.

Figure 7:
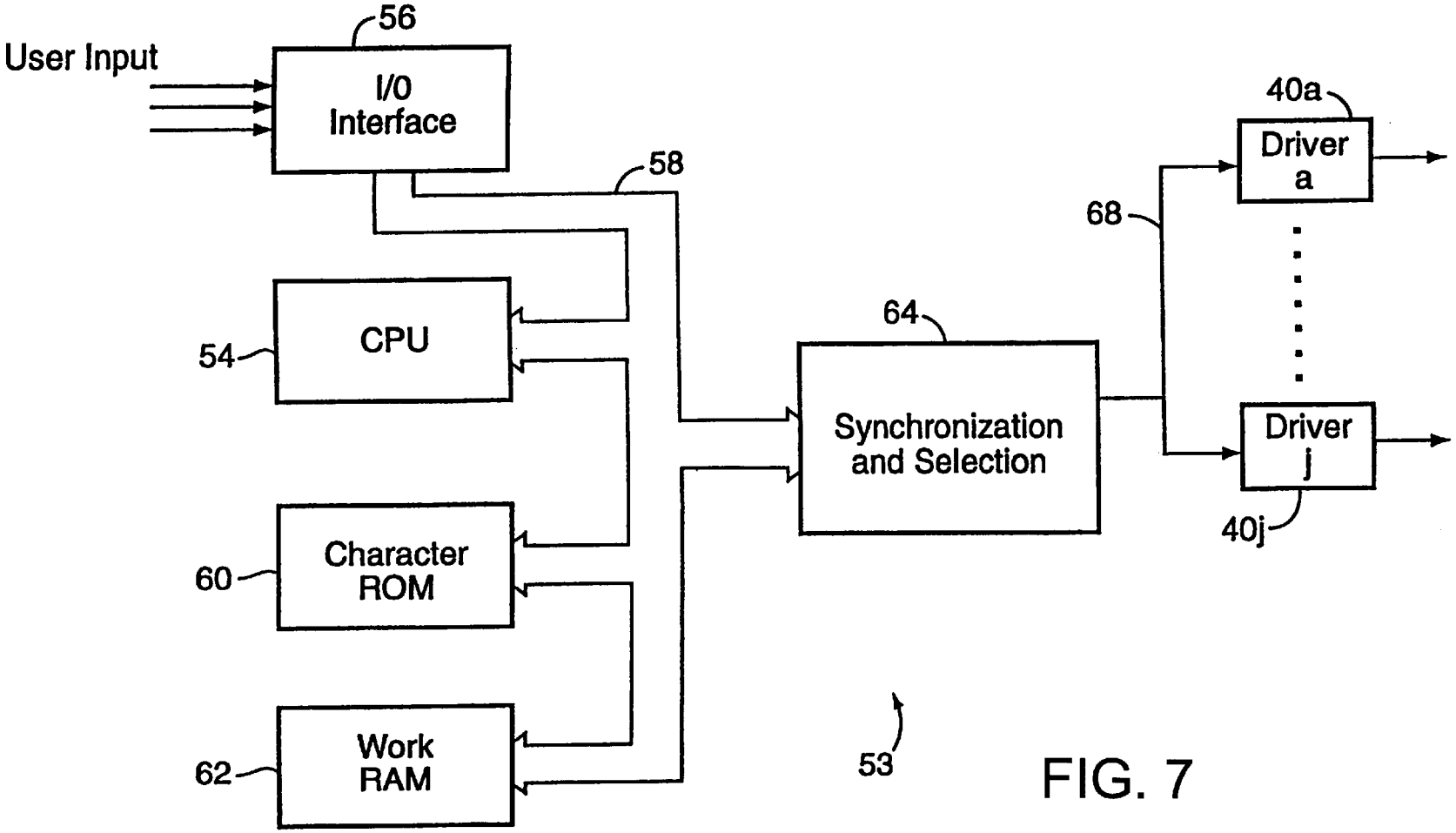
FIG. 7 illustrates a simplified block diagram of control circuitry for a writing instrument print-head made in accordance with FIG. 6, FIG. 6A and FIG. 6B.

Alternatively, suitable control circuitry may be employed to selectively actuate one or more of the ejection orifices. This may be utilized to create random patterns on the print medium or even generation of characters or the like with appropriate modification. By way of example, the patterns may comprise traditional symbols such as stars, squares or other geometric shapes or they may be other characters such as those that are popular with children. FIG. 7 shows a simplified block diagram representation of a control circuit 53 which may be employed. The control circuit 53 provides output signals to selectively actuate the respective ejection nozzles in the print-head 50 shown in FIG. 6. This embodiment utilizes a microprocessor or CPU 54 in conjunction with appropriate circuitry to generate control signals that are applied to a plurality of piezo-driver circuits 40*a* through 40*j*. For example, the driver circuits 40*a* through 40*j* may be functionally the same as circuit 40 described above in conjunction with FIG. 4.

In operation, the CPU 54 receives digital input signals from I/O Interface circuitry 56 via a bus 58. These signals are based on user input and selection. Based on this information, the CPU 54 accesses data contained in a Character ROM 60. The Character ROM 60 contains a library of patterns and/or characters that may be built or accessed by the CPU 54. The CPU 54 performs logical operations with data contained in the Character ROM 60 in conjunction with a Work RAM 62 and provides control data to a Synchronization and Selection circuit 64. This circuit 64 provides appropriate output signals on a line 68 to the plurality of driver circuits 40*a* through 40*n;* in this way various characters may be generated on the print medium.

The control circuit 53 may optionally receive input signals corresponding to the horizontal and vertical positions and movement of the marking device and of the print-head 50. For example, the I/O circuitry 56 may receive input signals from a track-ball or other device providing indicators of the positioning and movement of the marking device. This data is utilized by the CPU 54 and the synchronization and selection circuitry 64 to adjust the output provided to the respective driver circuits 40*a* through 40*j*. In addition, the control circuit 53 may receive signals from a contact switch or other suitable device located on the body 12 that provides an indication of when the body is in contact with the print medium or when the print-head 50 is in close relation with the print medium. This provides an additional safety feature that prevents unintended dispersion of ink from the marking device.

Figure 8:
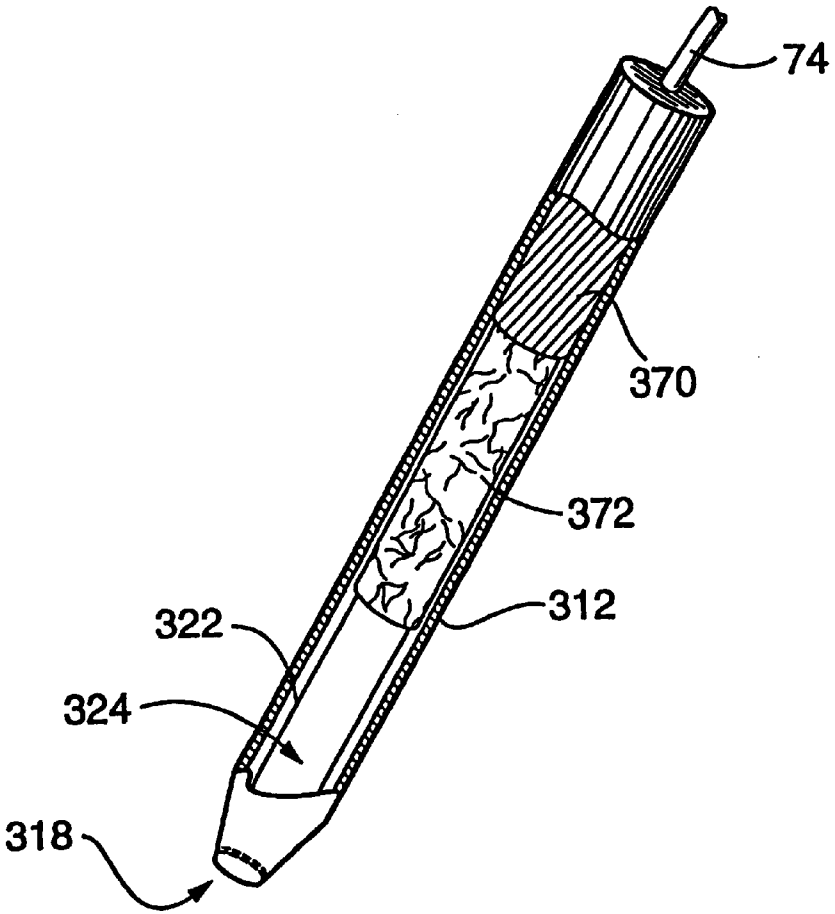
FIG. 8 is a partially cutaway perspective view of yet another embodiment of the present invention.

FIG. 8 illustrates a perspective view of yet another embodiment of the present invention with portions of the marking instrument body 312 removed for clarity. In this embodiment, a control circuit package 370 is designed for placement within the body 312 of the writing instrument. By way of example, the control circuit package 370 may contain circuitry to perform the functionality of the circuit shown 40 shown in FIG. 4 or the circuit 53 shown in FIG. 7. FIG. 8 also shows the ink cartridge 322 located within the cavity provided within the marker body 312 in abutting relation with the control circuit package 370. In this embodiment, the ink cartridge 322 is provided as a replaceable unit that includes the print-head 318, the ink reservoir 324, and a thin film battery 372 disposed in surrounding relation with respect to the ink reservoir 324. Suitable electrical contacts are provided to connect the battery 372 with the circuit elements within the control circuit package 370 and to connect the output terminals of the control circuit package 370 with the print-head 318.

In order to interfit within the cavity, the plurality of the elements in the electrical circuit package 370 may be provided as an integrated circuit package with appropriate modification. The circuit package is operable with the use of a pushbutton switch 374 preferably disposed at one end of the marker body 312. This structure provides a very compact design although the design may tend to increase the cost of manufacture of the marker.

Figure 9:
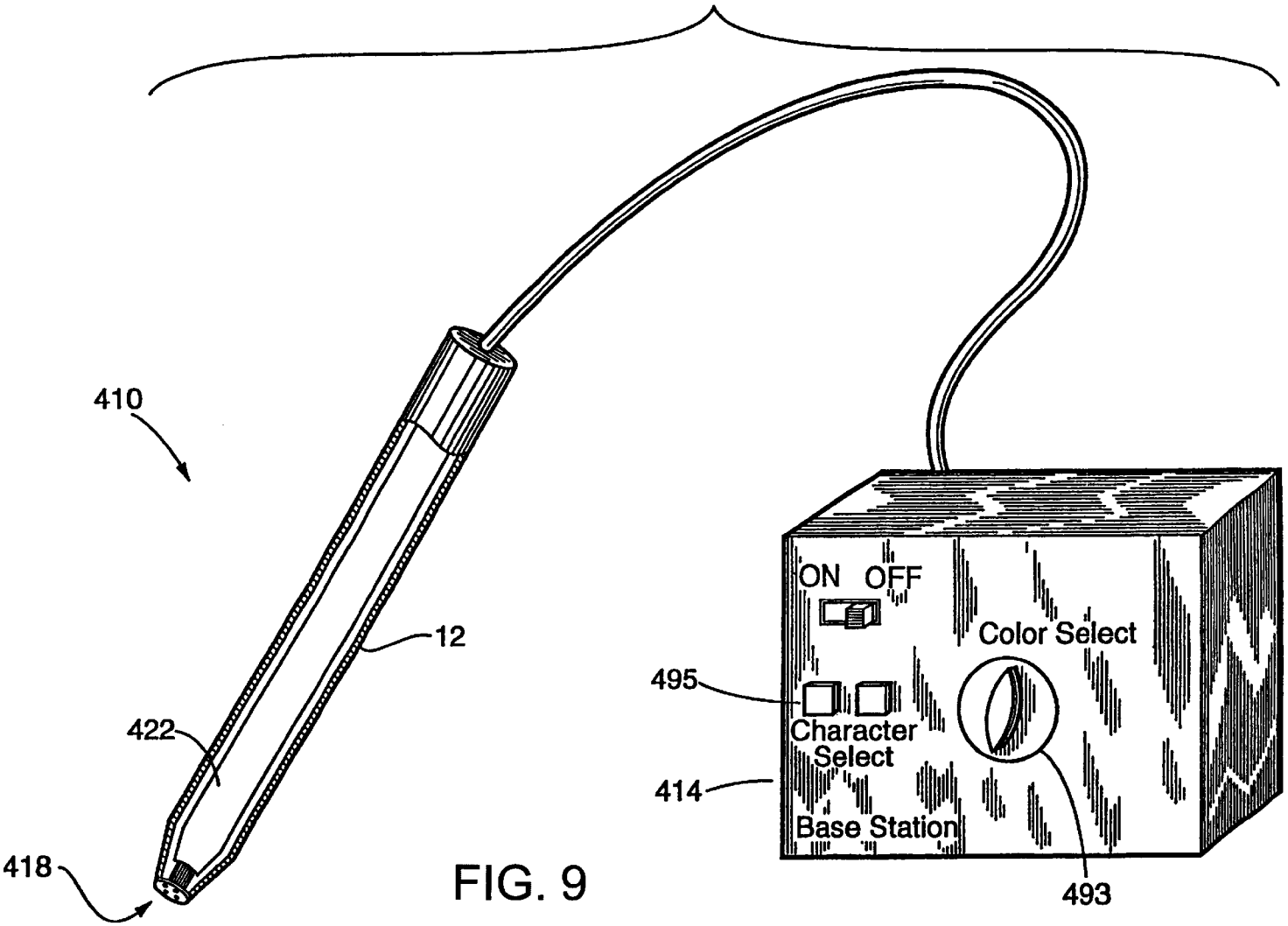
FIG. 9 is a partially cutaway view an embodiment of the present that is constructed to generate color printing.

FIG. 9 is yet another modification of the invention. In this embodiment, a color ink jet marking device 410 is shown that comprises a print-head 418 is equipped with one or more nozzles that eject yellow, cyan, magenta and black colors. By varying the controls provided on a base station 414, the marker 410 selects an appropriate mix of the primary colors to eject to the print medium. FIG. 9 also illustrates an ink cartridge 422 that is separated into four quadrants containing ink reservoirs corresponding to the yellow, cyan, magenta and black colors. These reservoirs are in fluid communication with the respective ejection nozzles located on the print-head 418 in a manner described above.

Figure 10:
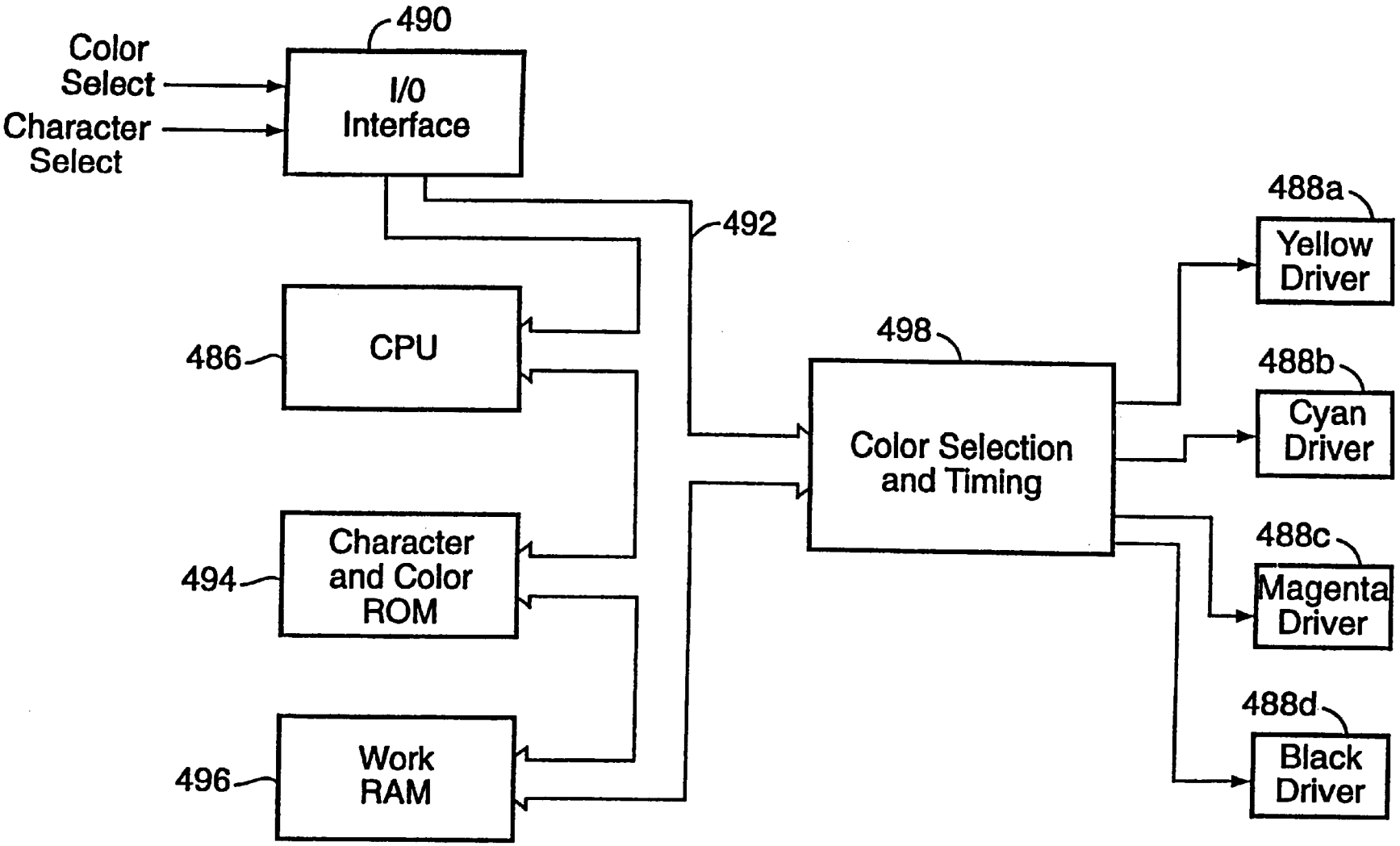
FIG. 10 illustrates a simplified block diagram of control circuitry for a writing instrument print-head made in accordance with FIG. 9.

FIG. 10 illustrates a simplified block diagram representation of control circuitry suitable for providing signals to the print-head 418 in the embodiment of FIG. 9. In this exemplary circuit construction, a microprocessor CPU 486 in conjunction with appropriate circuitry generates voltage regulated output signals that are applied to a plurality of driver circuits 488*a* through 488*d*. For example, the driver circuits 488*a* through 488*d* may be functionally the same as the circuit 40 described above in conjunction with FIG. 4. The CPU 486 receives digital input signals from I/O Interface circuitry 490 via a bus 492. These signals correspond to the desired color to be created on the print medium and are based on user selection of a control knob 493 or other suitable input device located on the base station 414 (see FIG. 9). In addition, the user may select desired patterns and/or characters with the use of input buttons 495.

Based on this information, the CPU 486 accesses data contained in a Character ROM 494. In addition to patterns and/or character, the ROM 494 may include a look-up table corresponding with the selected color. The CPU 486 performs logical operations with data contained in the Character ROM 494 in conjunction with a Work RAM 496 and provides control data to a Color Selection and Timing circuit 498. This circuit 498 provides appropriate output signals to the plurality of color driver circuits 488*a* through 488*d*. In this way, the size and duration of pulses applied to the respective ejection nozzles is varied to provide a desired color. The ink droplets are ejected onto the print medium in very close relation with each other so that the color perceived by the user is the additive colors ejected.

Figure 11:
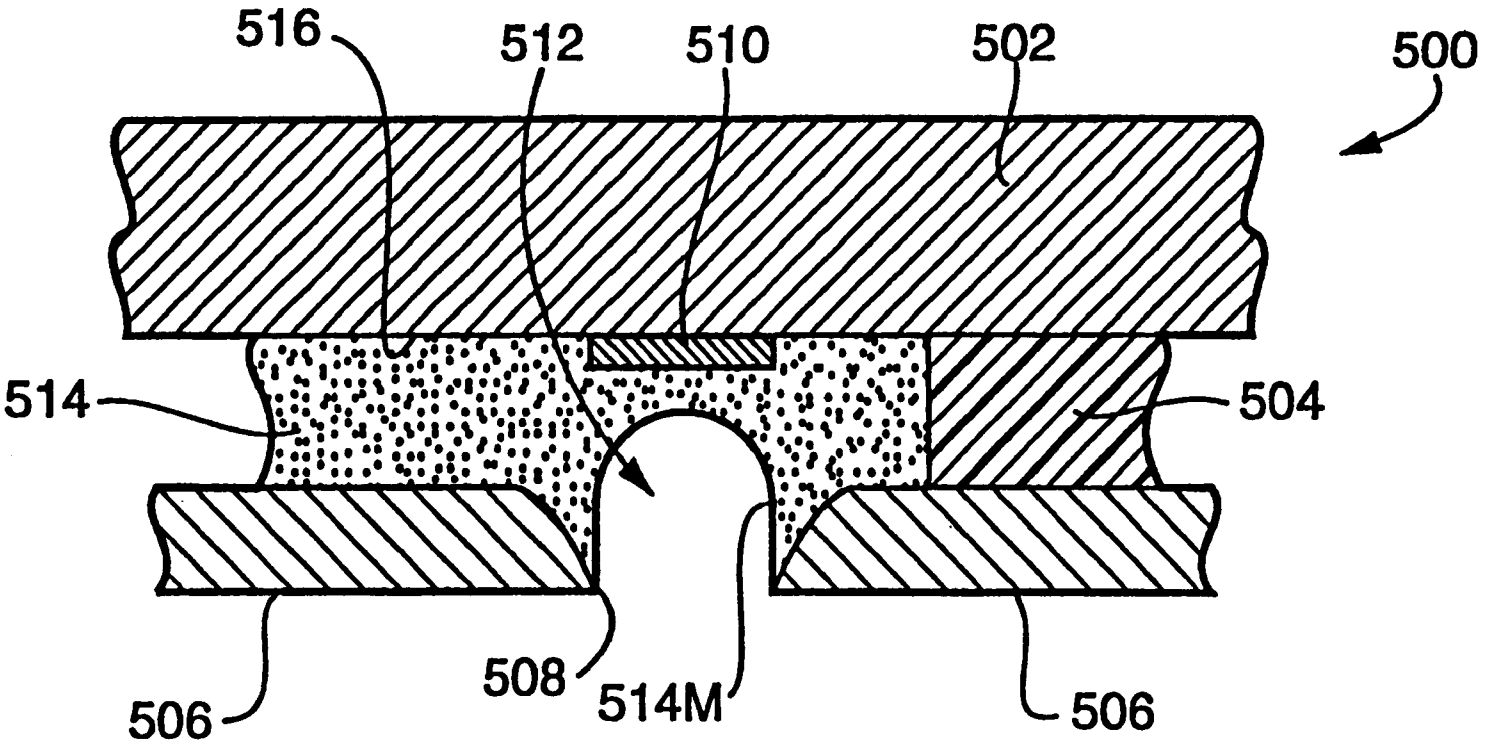
FIG. 11 is a cross-sectional view of a portion of a print-head made in accordance with another embodiment of the present invention.

Although embodiments of the invention are described herein in conjunction with a print-head that employs one or more ejection nozzles that utilize a vibratory element to generate ink droplets, it should be understood that the invention is not limited thereto. FIG. 11 illustrates a portion of a print-head 500 made in accordance with another embodiment of the present invention. The print-head 500 comprises a substrate 502, a barrier layer 504, and an orifice plate 506. The orifice plate 506 includes an opening or nozzle 508 disposed therein. The nozzle 508 is positioned in spaced relation from a thermal heating element 510 such as a resistor element. This area is sometimes known as a firing chamber 512. The orifice plate 506 typically includes a plurality of nozzles located therein, each of which is operatively associated with a resistor. For example, the orifice plate may be provided with a matrix of approximately 128 nozzles per ¼ square inches in the print-head.

In operation, ink denoted by the numeral 514 fills an ink feed channel 516. The feed channel provides ink proximate to each orifice such as orifice 508. The channel 514 is defined by the substrate 502, the barrier layer 504, and the orifice plate 506. The ink forms a meniscus denoted by numeral 514*m* following a drop ejection.

Each resistor such as resistor 510 is connected by an electrically conductive trace to a current source. The current source receives control signals from a control circuit or a computer. The control circuit provides appropriate signals so that current pulses are applied to selected resistors 510. When the current is applied to the resistor, the resistor generates heat. The generation of heat causes the ink in the firing chamber 512 to nucleate and expand. As a result, a droplet of ink is expelled through the nozzle 508 and onto the print medium. Ink is then drawn into the feed channel through capillary action.

The circuitry described above in conjunction with FIGS. 7 and 10 can be readily be modified in order to provide appropriate current pulses to the heater-resistors disposed in the print-head 500. In this way, the desired colors and/or patterns and intensity of the marking device may be provided. Additional details of operation in the context of thermal ink-jet printers are described in, for example, *Hewlett-Packard Journal,* Vol. 36, No. 5, May 1985, the subject matter of which is incorporated by reference.

Figure 12:
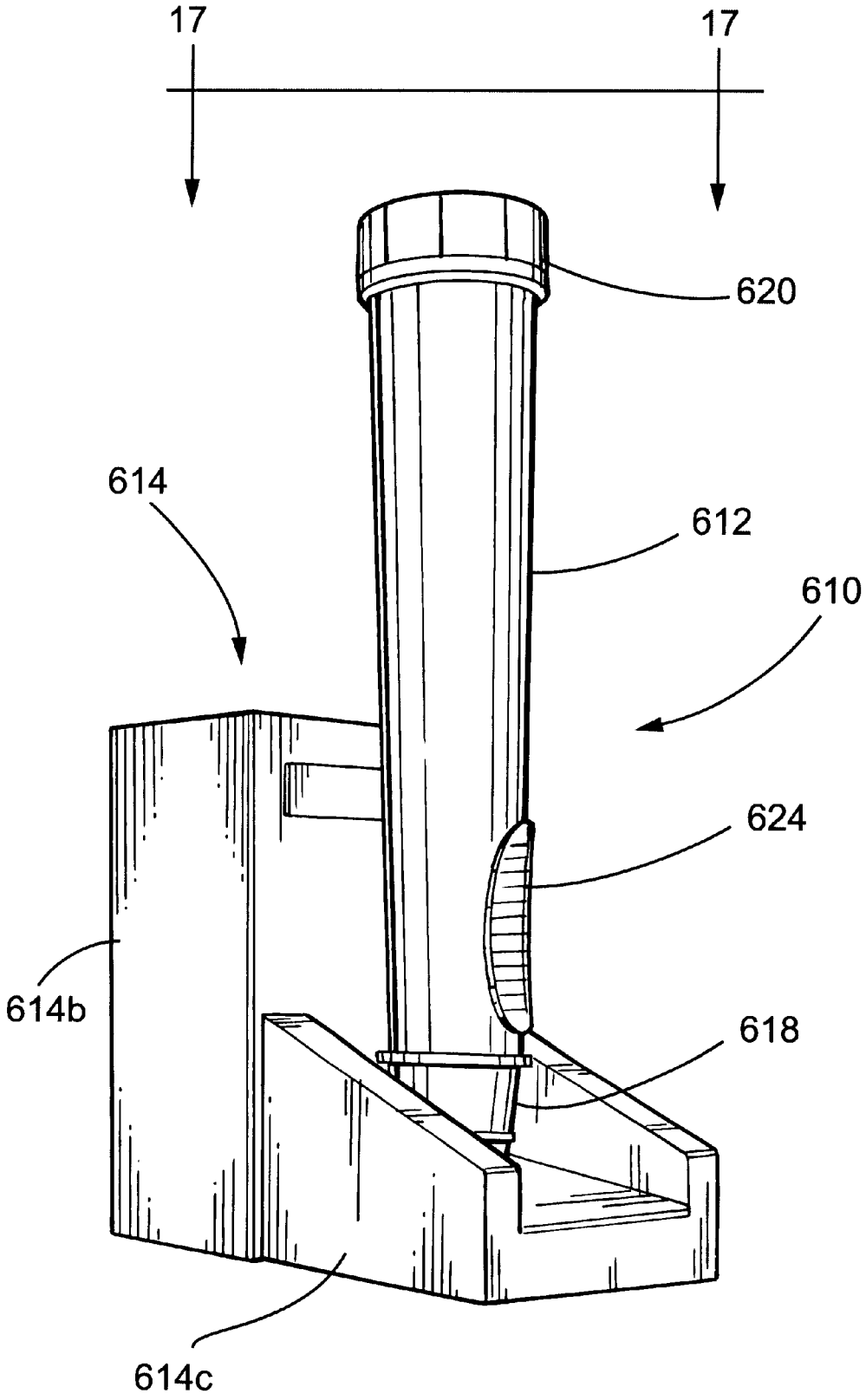
FIG. 12 is a perspective view of a further embodiment of the present invention.

FIGS. 12 through 18 illustrate yet a further embodiment of the present invention. As shown therein, a color ink jet marker 610 comprises a generally cylindrical marker body 612, having an approximate size and dimension as that of a conventional marker. The ink jet marker comprises a replaceable ink jet head 618, disposed at one end of the marker body 612. A replaceable ink cartridge 620 is disposed at the opposite end of the marker body 612. In this embodiment, the marker body 612 is used in combination with a docking station 614. As shown in FIG. 12, the marker body 612 is docked in a generally upright position within the docking station 614. The docking station 614 preferably charges a rechargeable power supply provided in the marker 610, among other things. As explained below, this arrangement avoids the requirement for conventional batteries for the marker 610.

In this regard, the docking station comprises a body section 614*b* and a cradle section 614*c,* disposed at one end of the docking body 614*b*. The cradle section 614*c* comprises opposed tapered side walls and a bottom wall which form an opening that is adapted to receive the marker body 612. In addition, the cradle section is formed to retentively engage the marker body 612 when in a recharging mode of operation. That is, the color ink jet marker 610 is located within a recess formed in the cradle section 614*c*. In this position, a plurality of power conductors, which are slightly recessed from the outer circumference of the marker body, are matingly engaged with complementary conductors provided in the cradle section 614*c*.

In one embodiment, the marker body 612 and the cradle section further include complementary mechanical portions that further aid in the mating engagement between the electrical conductor portions of the marker body and the cradle section, respectively. For example, cradle section includes a recess formed therein for receiving an end of the marker. In addition, the marker body 612 may include a rib portion formed therein that is adapted to interfit within a grooved portion formed in the cradle section. When in mated engagement, the complementary power conductors in the marker and the cradle section are disposed in electrical contacting relation.

Figure 17:
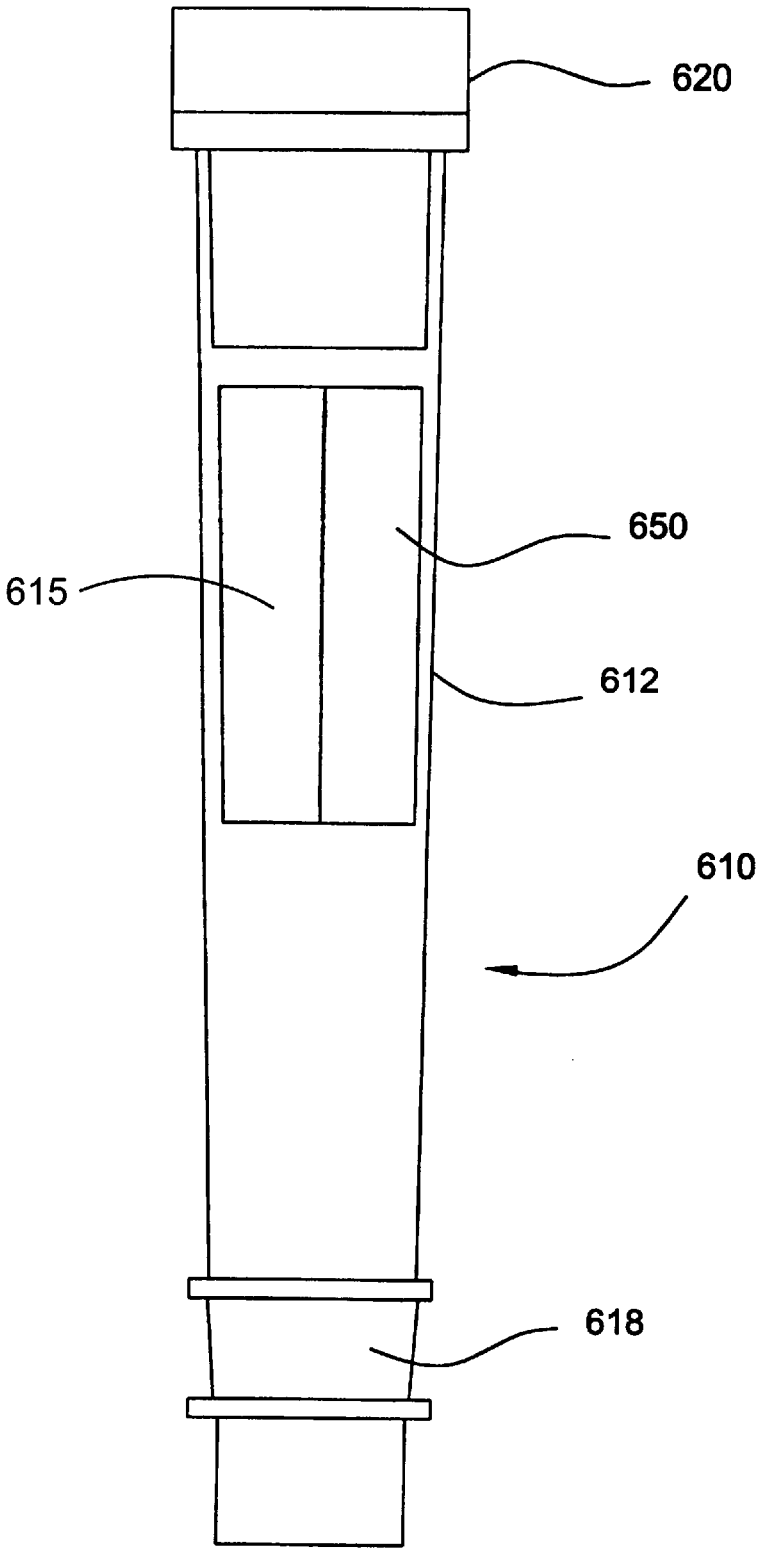
FIG. 17 is a cross sectional view of the marker shown in FIG. 12 taken along the lines 17—17 thereof.

When inserted into the cradle section in the position shown in FIG. 12, an internal power supply located in the marker may be readily recharged (see FIG. 17.) That is, when a rechargeable battery such as the battery 615 shown in FIG. 17 is used, placement of the marker within the cradle section results in an automatic recharging of the battery. In order to determine that the marker is properly seated within the cradle section, an indicator light may also be provided on the docking station 614.

This arrangement may further be used to provide an additional safety feature. That is, the marker may be placed in an inoperative state when located within the cradle of the docking station. By rendering the marker 610 inoperative when seated within the cradle section, the risk of inadvertent use is reduced.

For removing the marker body 612 from the cradle section 614*c*, the marker body is urged upwardly by the user of the marker. This action disengages the power conductors disposed on the marker body from the complementary conductors located on the cradle section. When disengaged, the marker is ready for use.

Figure 13:
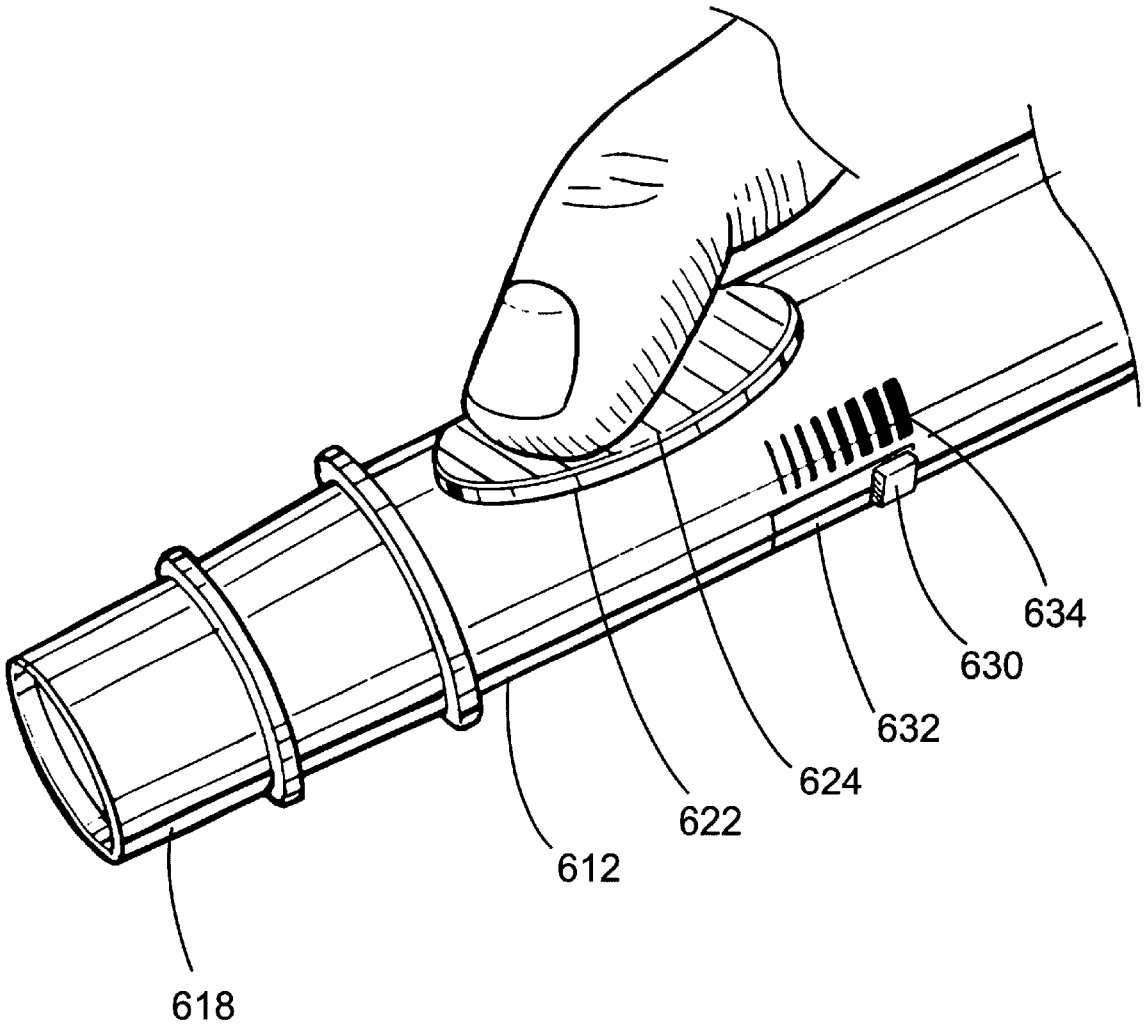
FIG. 13 is a perspective view of various input controls that may be used for an ink jet marker in the embodiment of FIG. 12.

The principal structural features for the marker are shown in FIGS. 12–16. As seen in FIG. 13, the ink jet marking head 618, disposed at an end of the marker body 612, is generally frustro-conical in its external shape. In this embodiment, the marking head 618 is removable from the marker body 612. It is preferably formed with a plurality of ejection nozzles such as the print head 500 illustrated in FIG. 11. Thus, the marking or head 618 comprises a plurality of spaced openings or nozzles formed in an orifice plate. These nozzles are positioned in spaced relation from corresponding thermal heating or resistor elements, which in turn, are connected through conductive traces to a current source. As further explained above, a microprocessor-based control circuit provides appropriate signals in order to generate current pulses that are applied to the resistors. The resulting generation of heat causes expansion of the ink and the expulsion of droplets of ink.

Thus, the print head may be provided in a "fire-on-demand" arrangement and expel ink in a rainbow format, such as in a 6×12 array or a 4×64 array wherein each of the colors has 64 nozzles.

Figure 14:
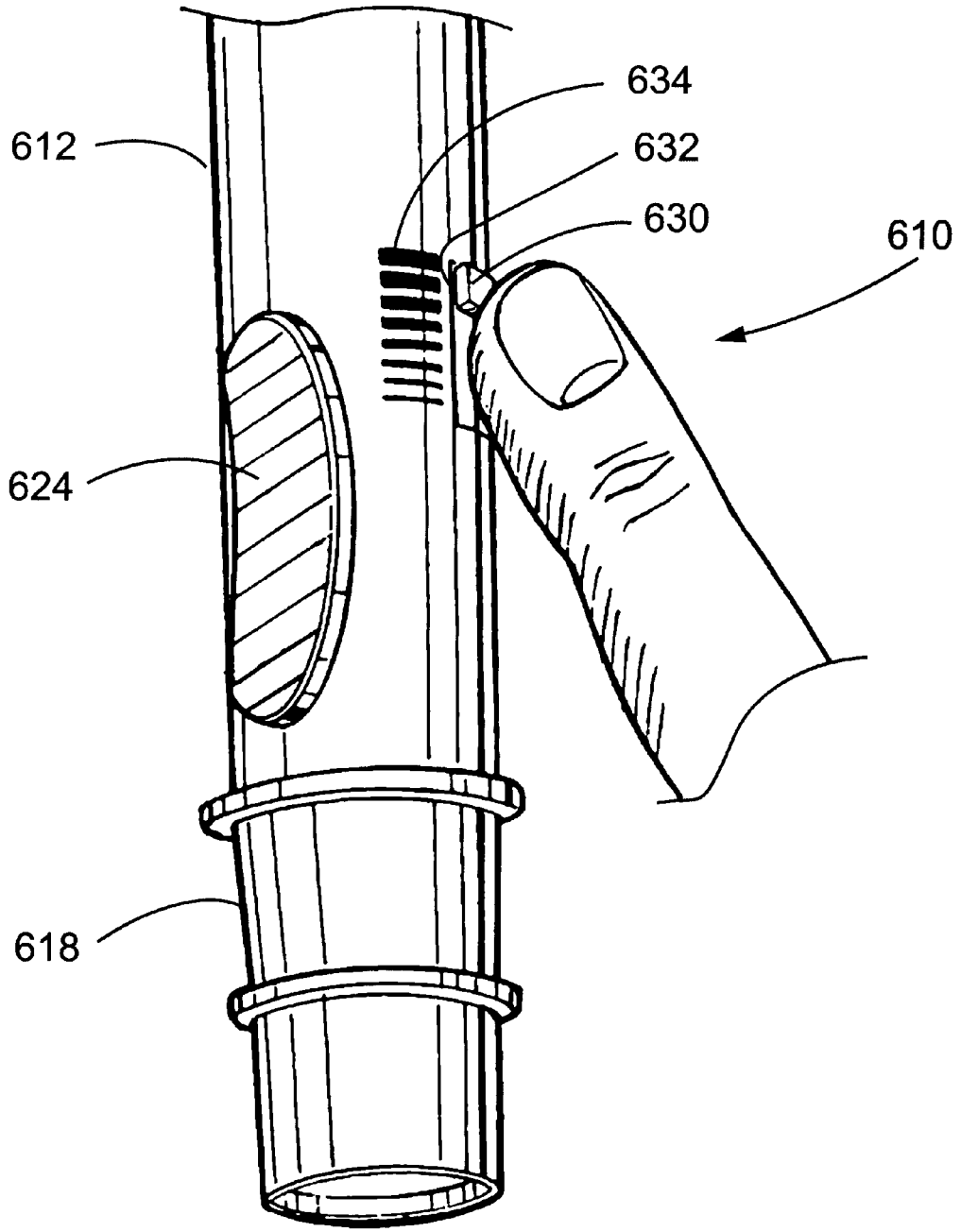
FIG. 14 is another perspective view of the embodiment illustrated in FIG. 12, showing actuation of a slider control.

For providing enhanced usability of the marking device, various input controls are located for ready access and manipulation by the user. The body includes a receptacle 616 formed therein in order to receive an oval-shaped ink activator 624. In the preferred embodiment, the ink activator 624 located at a position along the longitudinal dimension of the marker body where it may be readily engaged by the index finger of the user during a conventional writing operation, as shown in FIGS. 13 and 14. The ink activator 624 is pressure sensitive such that it will close a master "on/off" switch for the electronics of the marker only when a predetermined pressure is applied to the activator for a fixed time interval. In this way, the marker is activated only when intended for use in marking operations. Also, the sensation perceived by the user is that ink is ejected and the marker is activated as the user applies a desired pressure to the marker as would be applied with a conventional writing instrument.

The marker 610 further includes a generally rectangular slider control 630, disposed proximate to the ink activator 624, for applying ink in a desired thickness. The slider control 630 is located within a longitudinally extending channel 632 formed in the marker body. As shown, the slider control protrudes slightly outwardly from the marker body and is further movable within the channel 632 between a spectrum of desired marker line thicknesses. Such line thicknesses are preferably denoted on the outer surface of the marker body as a plurality of spaced indicator lines 634, as shown in FIGS. 13 and 14. The indicator lines illustrate a progressively greater line thickness. This corresponds to the line thickness dispensed by the marker. That is, when the slider control 630 is urged into the position shown in FIGS. 13 and 14, the marker generates a relatively thick line. On the other hand, when the slider control is moved to the opposite end of the channel 632, the marker will generate a relatively thin line. Of course, movement of the slider control to a position between the end positions results in the generation of a marker line having a corresponding thickness.

Figure 15:
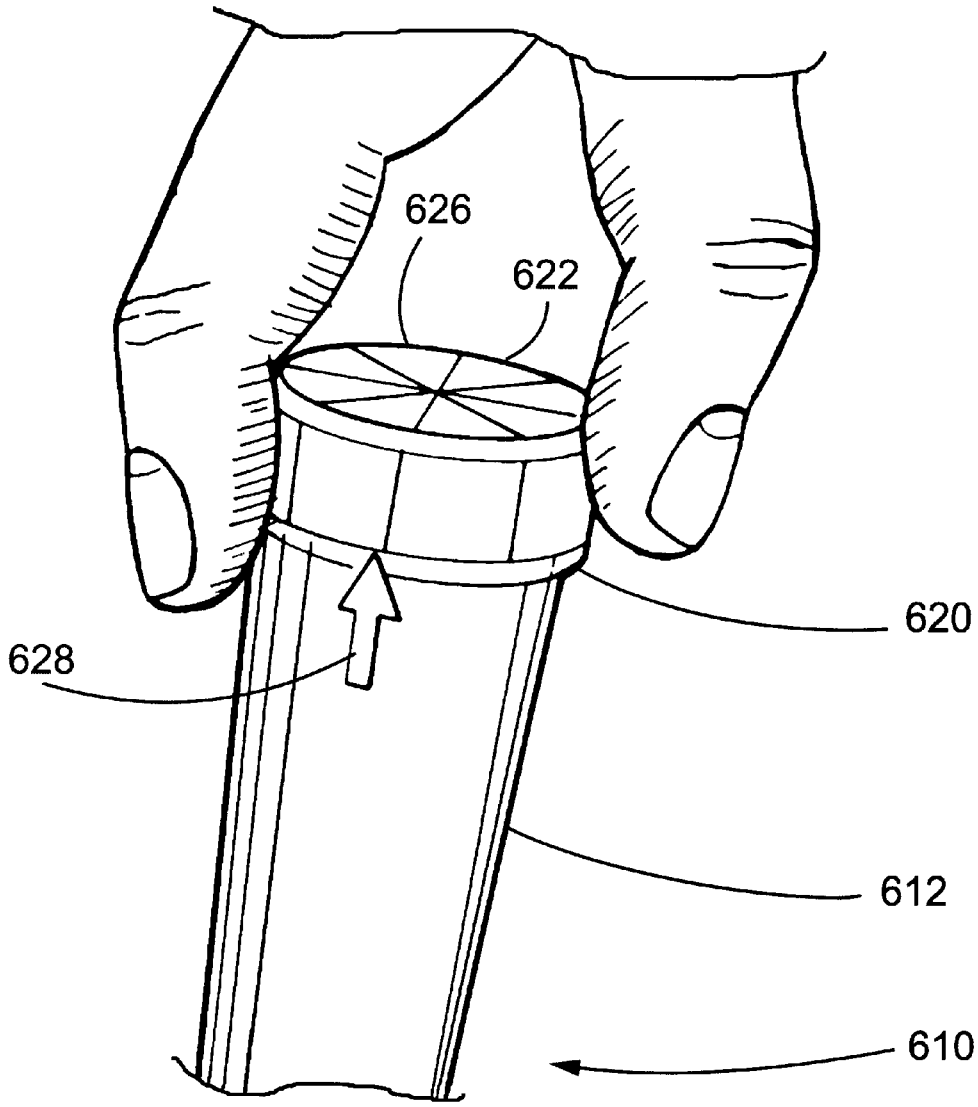
FIG. 15 is a perspective view of the embodiment illustrated in FIG. 12, illustrating a rotatable control knob located on end of the marker.
Figure 16:
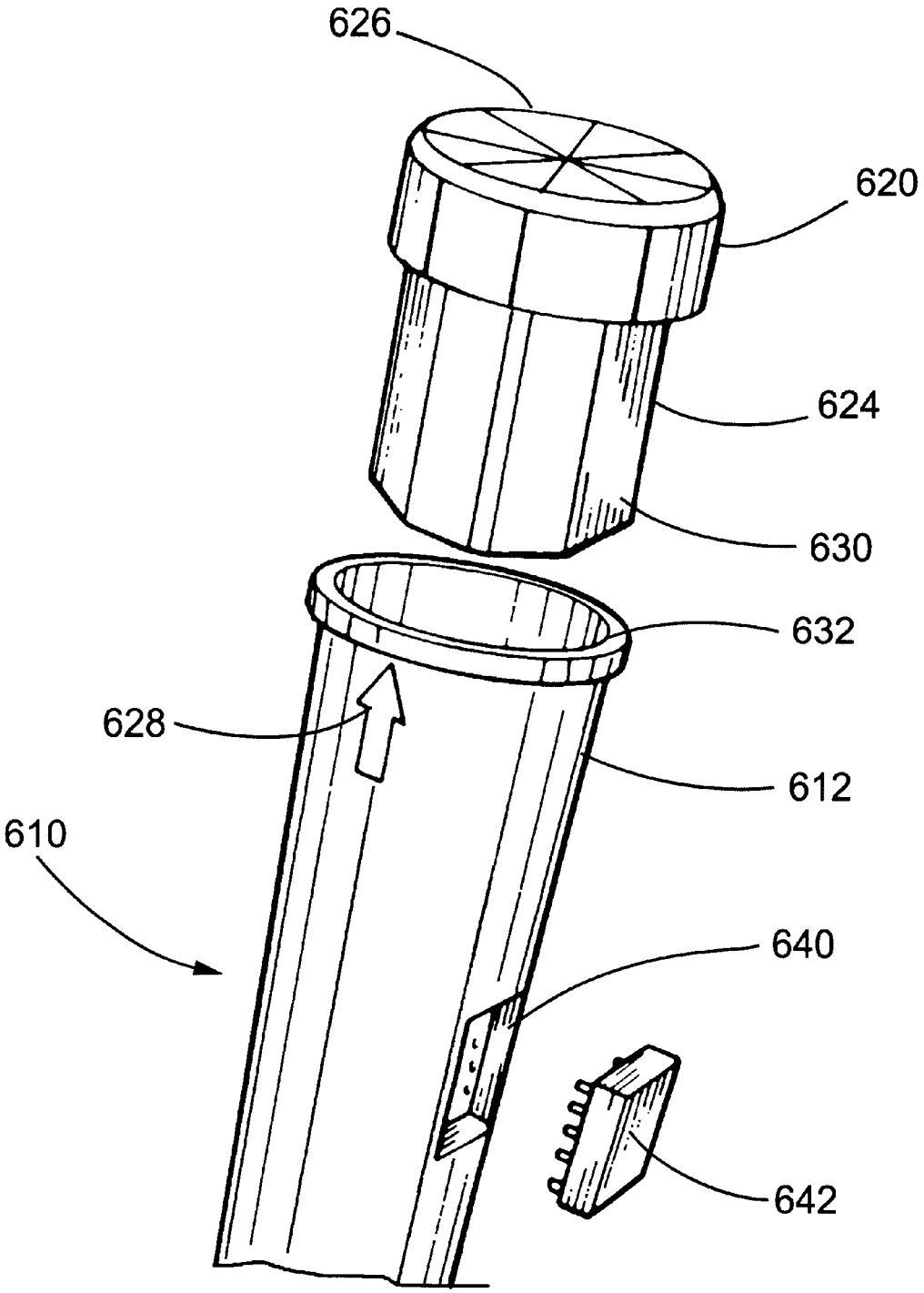
FIG. 16 is an exploded view of the marker shown in FIG. 15, illustrating a removable ink cartridge and a removable integrated circuit package according to one embodiment of the invention.

For providing a source of ink for the marker, a replaceable color cartridge is provided. As best seen in FIGS. 15 and 16, the ink source is preferably implemented as a generally cylindrical cartridge 620, located opposite the print head. The cartridge further includes two portions: a head portion 622 and a body portion 624. The head portion 622 is divided into a plurality of equi-spaced pie-shaped segments of varying colors such as colored segment 626. The colored segments extend from the face of the head portion and overlap the side thereof as shown in FIGS. 15 and 16. While the cartridge preferably is divided into quadrants that contain four primary colors, yellow, cyan, magenta and black, the number of color segments is substantially greater. As explained below, a particular desired color is obtained through mixing the colors ejected onto the print medium. This arrangement permits the user to align a desired colored segment with a marker such as arrow 628, disposed on the outer circumference of the marker body 612.

As best seen in FIG. 16, the outer surface of the body section 624 for the cartridge includes flattened segments such as segment 630. These flattened segments are sized to mate with complementary segments formed in a receptacle 632 for the cartridge such that, when placed within the receptacle, the cartridge fixedly disposed at a preselected orientation. The receptacle 632, in turn, is rotatably mounted within the marker body 612. As seen in FIG. 15, in order to select a desired color, the user rotates the cartridge head section 620 until a desired one of the spaced colored segments is aligned with the marker arrow 628. As explained below, rotation of the ink cartridge causes movement of the cartridge receptacle. This movement, in turn, provides a desired input signal to the control circuitry. In response, the control circuitry generates appropriate control signals for outputting the desired color.

In order to permit the creation of enhanced patterns by the user, the marker permits the installation of plug-in memory. In one implementation, the marker includes a generally rectangular socket 640 located on the outer circumference of the marker body 612. The socket 640 is sized to receive a memory integrated circuit or "stamping chip" 642, as shown in FIG. 16. In one embodiment, the marker control circuit automatically performs a system reconfiguration whenever the user removes a stamping chip from the socket 640. Similarly, the system automatically reconfigures itself whenever a stamping chip is inserted into the socket 640. In this way, the user may easily install one of many stamping chips that are contemplated by the invention or remove the chip altogether without performing a reset of the marker control circuitry.

Figure 18:
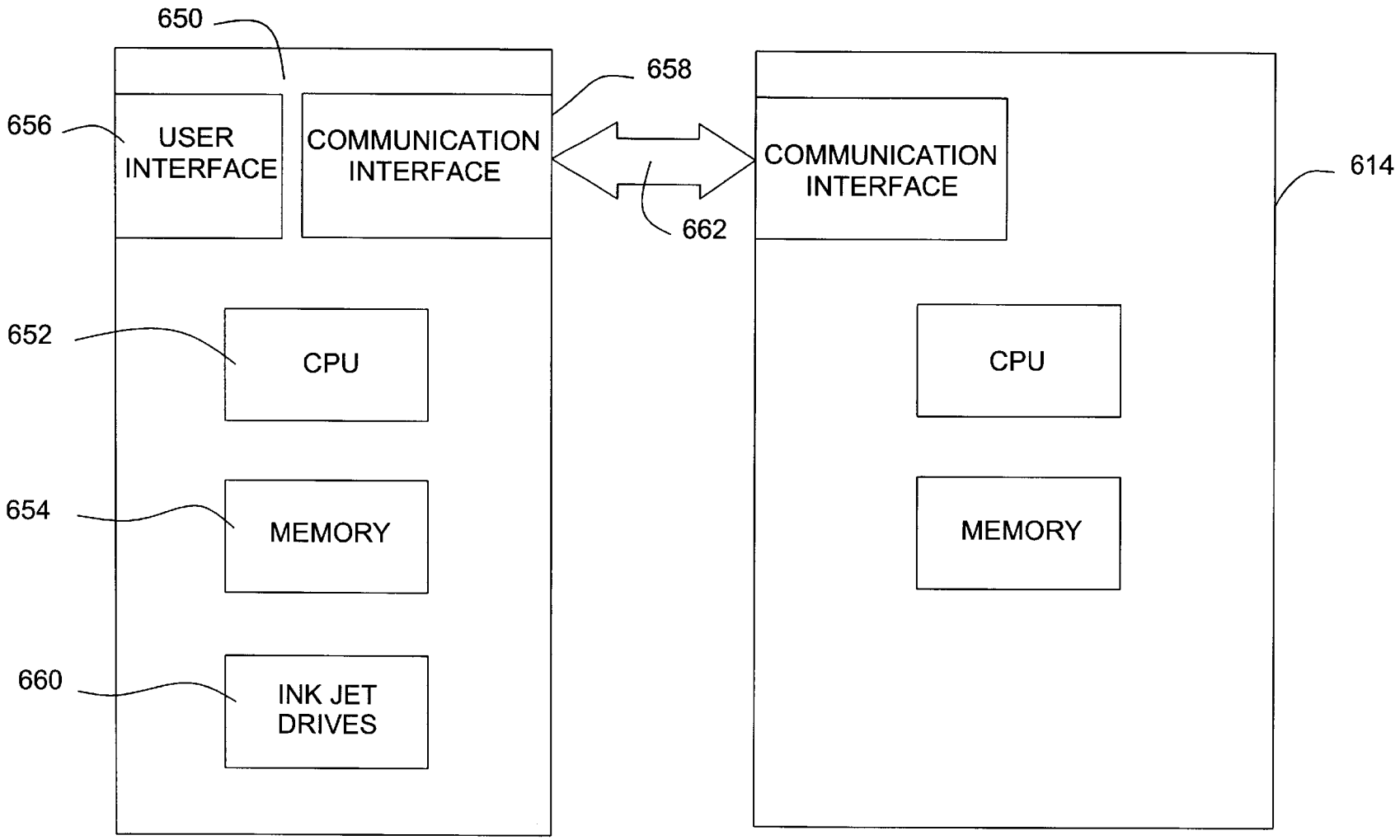
FIG. 18 is a simplified block diagram representation of a control circuit for the present invention.

One suitable control circuit for this embodiment of the invention is shown in FIG. 18. The ink jet marker control circuitry 650 may use any type of small microprocessor based computer system such as those used in a cellular phone or personal information manager environment. The microprocessor or CPU 652 is connected through an address/data bus to memory 654, user interface circuitry 656, a communication interface, and ink jet driver circuitry 660, which may be similar to that described above in conjunction with FIG. 10. It should be understood that memory 654 includes the removable stamping chip memory described above as well as system memory. The user interface circuitry 656 receives the signals provided by the pressure sensitive ink activator button 624, the thickness control slider 630, and the ink color indicator input.

The marker circuitry 650 uses this input information to provide appropriate output information to the ink jet driver circuitry 660. In this way, the marker provides a desired output of color droplets in a desired pattern.

In addition to providing access to electrical power, the docking station 614 may also provide data synchronization and control signals to the marker. For example, data transfer and synchronization between the marker and the docking station may be accomplished through a Universal Serial Bus (USB) adapter or other suitable connection means denoted by the connection 662 in FIG. 18. Thus, in addition to providing power to the marker, the docking station may perform diagnostic functions on the marker. In addition, the docking station may transfer additional programmatic functions to the marker as well as receive status information.

Various modifications may be readily employed to the ink jet marker according to this embodiment. For example, the electrical control circuitry may further include a display located on the marker body. The display may provide such useful information to the user such as an icon that indicates the amount of life remaining in the battery, the type of stamping chip, if any, that is inserted into the IC receptacle and other information. Of course, the display may also be implemented as a segmented LED array for providing such information as alphanumeric characters.

The type of ink utilized in conjunction with the present invention is non-toxic, washable and non-flammable. The ink characteristics should also provide appropriate surface tension and density, while minimizing clogging and gas bubble formation. In this regard, a water-based ink provides an optimal surface tension comparable to the value of 76 dynes/cm obtained for water alone. The ink is also pH controlled in order to prevent shifting of the color of the dyes and corrosion of the print-head components.

Accordingly, an ink jet marker meeting the aforestated objectives has been described. The marker provides an easy-to-use writing instrument that is relatively simple in construction and design, while being quite versatile in operation. Of course, those skilled in the art will understand that other modifications may be incorporated, particularly upon consideration of the foregoing teachings. For example, the marking device may be provided as a peripheral device which is connectable to a personal computer with the inclusion of appropriate interface circuitry and software. Accordingly, the invention is intended to be covered by the appended claims, which are made part of this disclosure.

What is claimed is:

1. An ink jet marker comprising:

an elongate, generally cylindrical writing instrument body;

a replaceable ink jet cartridge disposed at least partially in said body, said cartridge including a plurality of ink reservoirs and presenting an end cap for said marker at one end thereof, said end cap providing visual cues to the user for selecting a desired color of ink;

an ink jet writing head disposed at the opposite end of said body, coupled with said reservoir adapted to dispense a selected amount of ink upon receipt of first control signals;

a first user input located on said marker body comprising a finger-engageable ink activator disposed to generate input signals only when depressed by the user;

an electrical control circuit disposed to receive said input signals and to provide said first control signals, said electrical control circuit including a power source with a plurality of terminals; and a docking station adapted to receive said writing instrument body, said docking station including a recharging circuit with complementary electrical terminals for engaging said electrical control circuit terminals when said writing instrument body is received within the docking station, to recharge said electrical control circuit power source.

2. The invention as in claim 1 wherein said ink jet print-head comprises a plurality of ejection nozzles in fluid communication with said ink reservoirs.

3. The invention as in claim 2 wherein said electrical control circuit applies said first control signals to desired ones of said ejection nozzles located on the ink jet writing head.

4. The invention as in claim 3 wherein the electrical control circuit applies said first control signals to desired ones of said ejection nozzles in response to user input concerning a desired color.

5. The invention as in claim 1 further comprising a slider control, located on the marker body, for providing input signals to said electrical control circuit to generate a pattern of a desired thickness on a print medium.

6. The invention as in claim 1 wherein said ink cartridge further comprises first segments sized to be received within complementary segments formed in a receptacle for the cartridge located within the writing instrument body, said cartridge when disposed in said receptacle being rotatably mounted relative to said writing instrument body to permit user selection of one of a plurality of colors.

7. The invention as in claim 1 further comprising an integrated circuit in communication with said electrical control circuit for providing input signals to said electrical control circuit to generate a desired pattern to be applied on a print medium.

8. The invention as in claim 7 wherein said ink jet writing head includes:

at least one heater element, said heater element being disposed in a firing chamber supplied with ink from one of said ink reservoirs; and a nozzle member including at least one nozzle associated with said heater element, through which droplets of ink are expelled toward a print medium when said heater element is actuated.

9. The invention as in claim 1 wherein said ink jet writing head includes:

at least one heater element, said heater element being disposed in a firing chamber supplied with ink from one of said ink reservoirs; and a nozzle member including at least one nozzle associated with said heater element, through which droplets of ink are expelled toward a print medium when said heater element is actuated.

10. The invention as in claim 1 wherein the electrical control circuit executes a plurality of computer executable instructions for providing said first control signals to generate a desired pattern on a print medium.

11. The invention as in claim 1 further comprising input controls permitting selection of a mix of colors in response to user input concerning a desired color.

12. The invention as in claim 1 wherein a mix of colors is dispensed by said ink jet writing head in response to user input concerning a desired color.

* * * * *

UNITED STATES PATENT AND TRADEMARK OFFICE

CERTIFICATE OF CORRECTION

PATENT NO. : 6,394,598 B1
DATED : May 28, 2002
INVENTOR(S) : Richard J. Kaiser

It is certified that error appears in the above-identified patent and that said Letters Patent is hereby corrected as shown below:

Column 11,
Line 27, "interface" should read -- interface 658 --.
Line 46, "by the connection 662 in FIG. 18" should read -- by the bus 662 and associated communication interface circuitry in FIG. 18 --.

Signed and Sealed this

Twenty-ninth Day of June, 2004

JON W. DUDAS
*Acting Director of the United States Patent and Trademark Office*